US008568280B2

(12) United States Patent
Mendoza

(10) Patent No.: US 8,568,280 B2
(45) Date of Patent: Oct. 29, 2013

(54) SEPARABLE WEIGHT ADJUSTABLE MEDICINE BALL

(76) Inventor: Ernest Richard Mendoza, San Antonio, TX (US)

( * ) Notice: Subject to any disclaimer, the term of this patent is extended or adjusted under 35 U.S.C. 154(b) by 211 days.

(21) Appl. No.: 13/218,357

(22) Filed: Aug. 25, 2011

(65) Prior Publication Data

US 2012/0053024 A1 Mar. 1, 2012

Related U.S. Application Data

(60) Provisional application No. 61/376,791, filed on Aug. 25, 2010, provisional application No. 61/377,226, filed on Aug. 26, 2010.

(51) Int. Cl.
*A63B 21/072* (2006.01)
*A63B 21/06* (2006.01)

(52) U.S. Cl.
USPC ..... 482/108; 482/93

(58) Field of Classification Search
USPC ..... 482/92–94, 97–98, 106–108, 908
See application file for complete search history.

(56) References Cited

U.S. PATENT DOCUMENTS

| | | | | |
|---|---|---|---|---|
| 6,387,022 | B1 * | 5/2002 | Smith | 482/106 |
| 7,052,445 | B2 * | 5/2006 | Ekhaus | 482/93 |
| 7,491,157 | B1 * | 2/2009 | Lin | 482/108 |
| 7,563,208 | B1 * | 7/2009 | Chen | 482/93 |
| 7,762,933 | B1 * | 7/2010 | Yu | 482/107 |
| 8,128,537 | B2 * | 3/2012 | Signorile et al. | 482/94 |
| 2007/0135274 | A1 * | 6/2007 | Blateri | 482/109 |
| 2011/0263393 | A1 * | 10/2011 | Ross et al. | 482/93 |

* cited by examiner

*Primary Examiner* — Loan Thanh
*Assistant Examiner* — Jennifer M Deichl
(74) *Attorney, Agent, or Firm* — Sinorica, LLC

(57) ABSTRACT

The present invention is a separable weight adjustable medicine ball, which can be used in a variety of exercise routines. The present invention is primarily comprised of two pieces, which can either be separated to perform exercises that involve dumbbells or push-up handles or be combined to perform exercises that involve a medicine ball. The present invention allows a user to incrementally increase the exercising load with a plurality of weights. The plurality of weights is separated between the two pieces and held in place with a pair of weight supports. The plurality of weights is secured on the pair of weight supports with a pair of collar clamps. The collar clamp is an user-friendly device that can be opened by squeezing the sides of the collar clamp and can be closed by releasing the sides of the collar clamp.

9 Claims, 12 Drawing Sheets

SEPARABLE WEIGHT ADJUSTABLE MEDICINE BALL

The current application claims a priority to the U.S. Provisional Patent application Ser. No. 61/376,791 filed on Aug. 25, 2010 and the U.S. Provisional Patent application Ser. No. 61/377,226 filed on Aug. 26, 2010.

FIELD OF THE INVENTION

The present invention relates generally to an exercise device. More particularly, the present invention is an exercise device that allows the user to perform numerous workouts of different muscle areas.

BACKGROUND OF THE INVENTION

Currently, effectively working out different areas of muscle requires the user to perform many different workout routines. Consequently, people who wish to efficiently work various muscles must acquire many different workout machines and devices to effectively do so. In order to acquire these numerous workout machines, the user must purchase them which can often be a financial strain. Additionally, this large number of machines can be very space consuming, often requiring an entire room to contain them in. The present invention is a medicine ball with handles comprising within an outer casing a plurality of weights and clamps positioned onto a weighted base and bar. The plurality of weighted components is attached and can be separated to allow the user to perform different workouts and work different muscles. Thus, the consumer can save time, money, and space by using the present invention to perform different exercises rather than purchase many different devices.

DETAIL DESCRIPTIONS OF THE INVENTION

All illustrations of the drawings are for the purpose of describing selected versions of the present invention and are not intended to limit the scope of the present invention.

Figure 1:
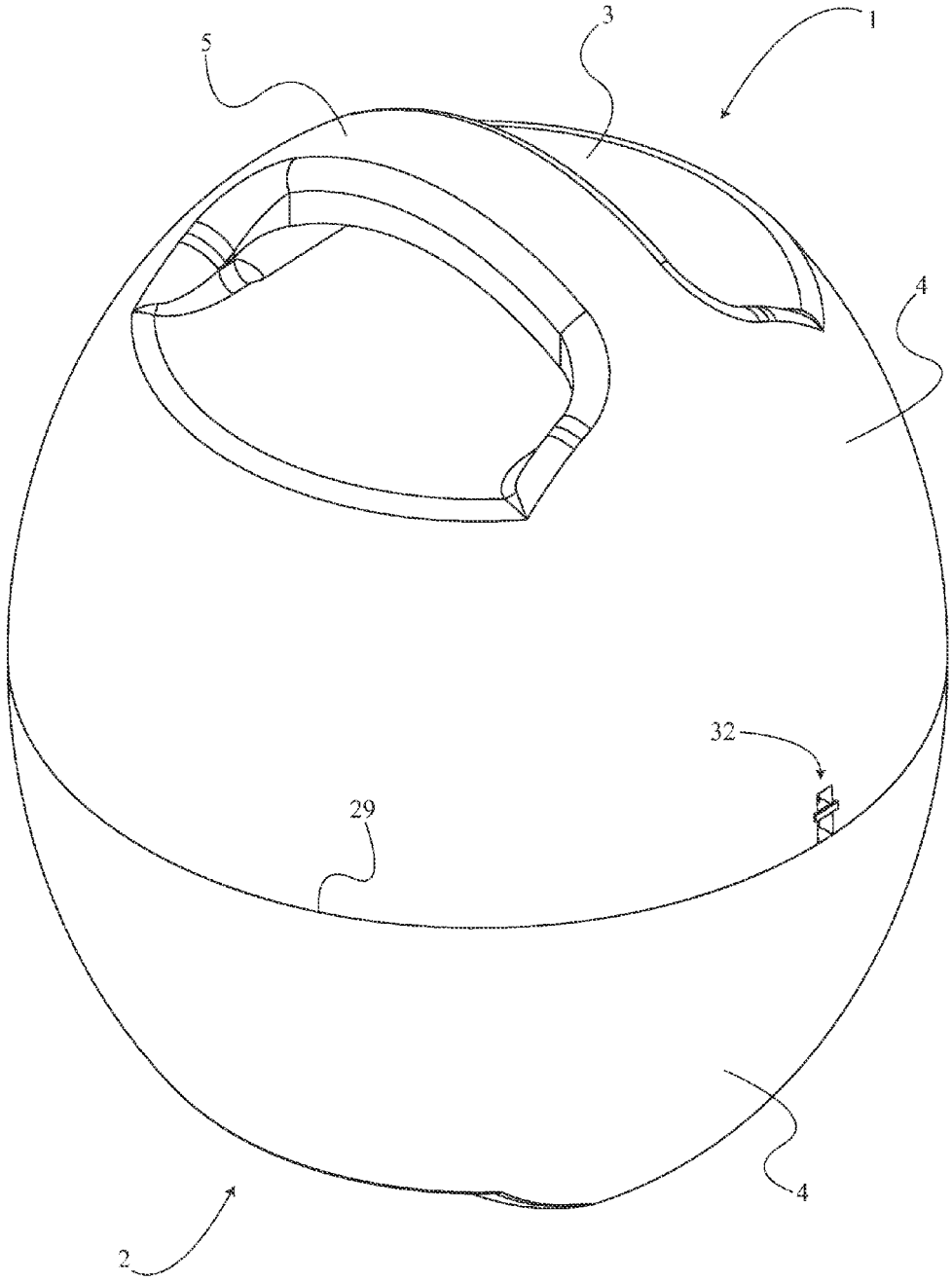
FIG. 1 is a perspective view of the present invention, which is assembled to function as a medicine ball.
Figure 2:
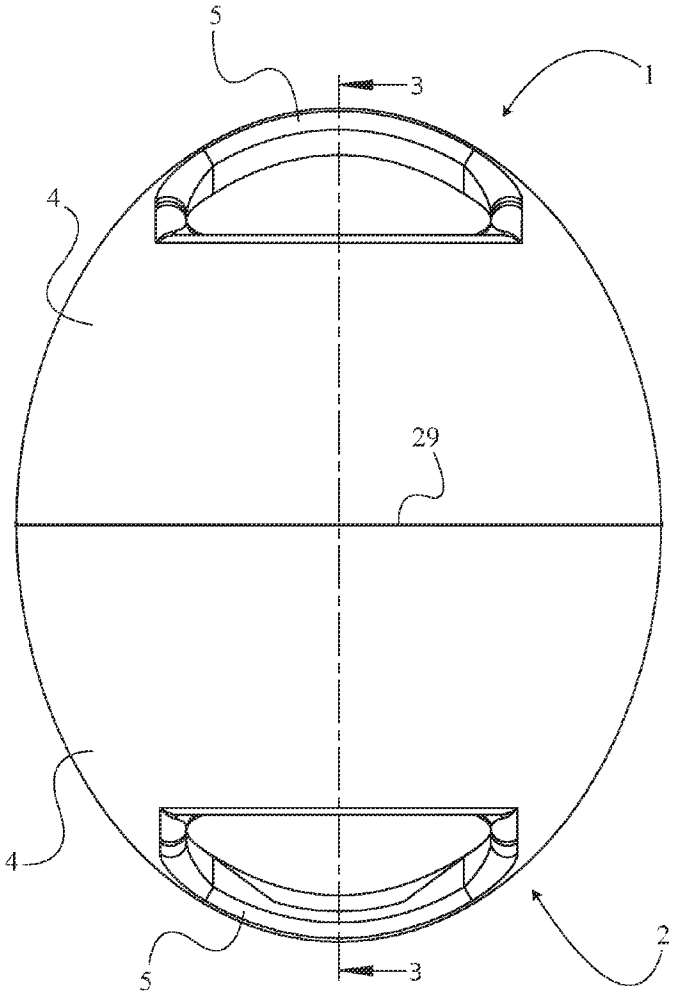
FIG. 2 is front view of the present invention, which is assembled to function as a medicine ball.
Figure 4:
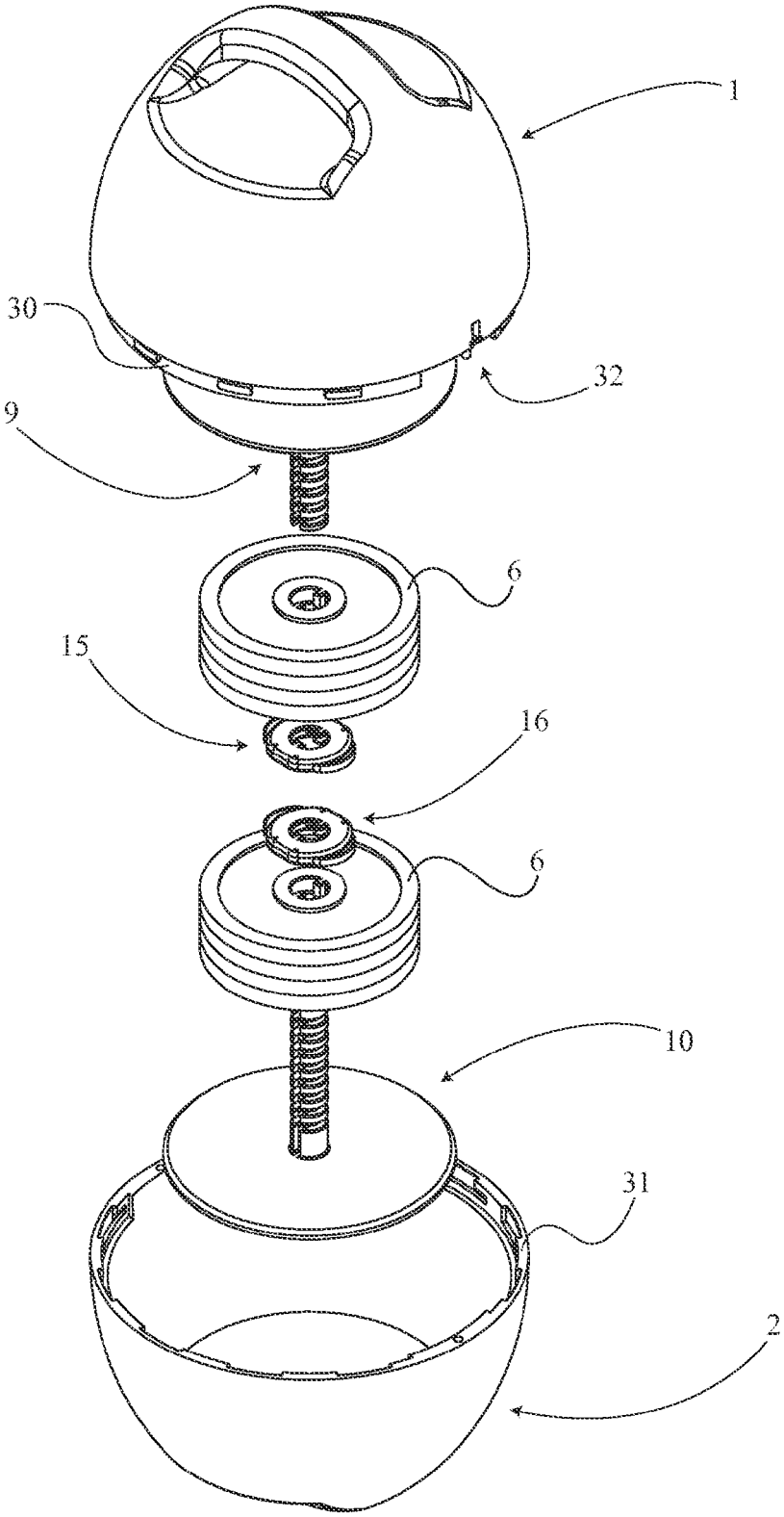
FIG. 4 is an exploded perspective view of the present invention's major components.
Figure 5:
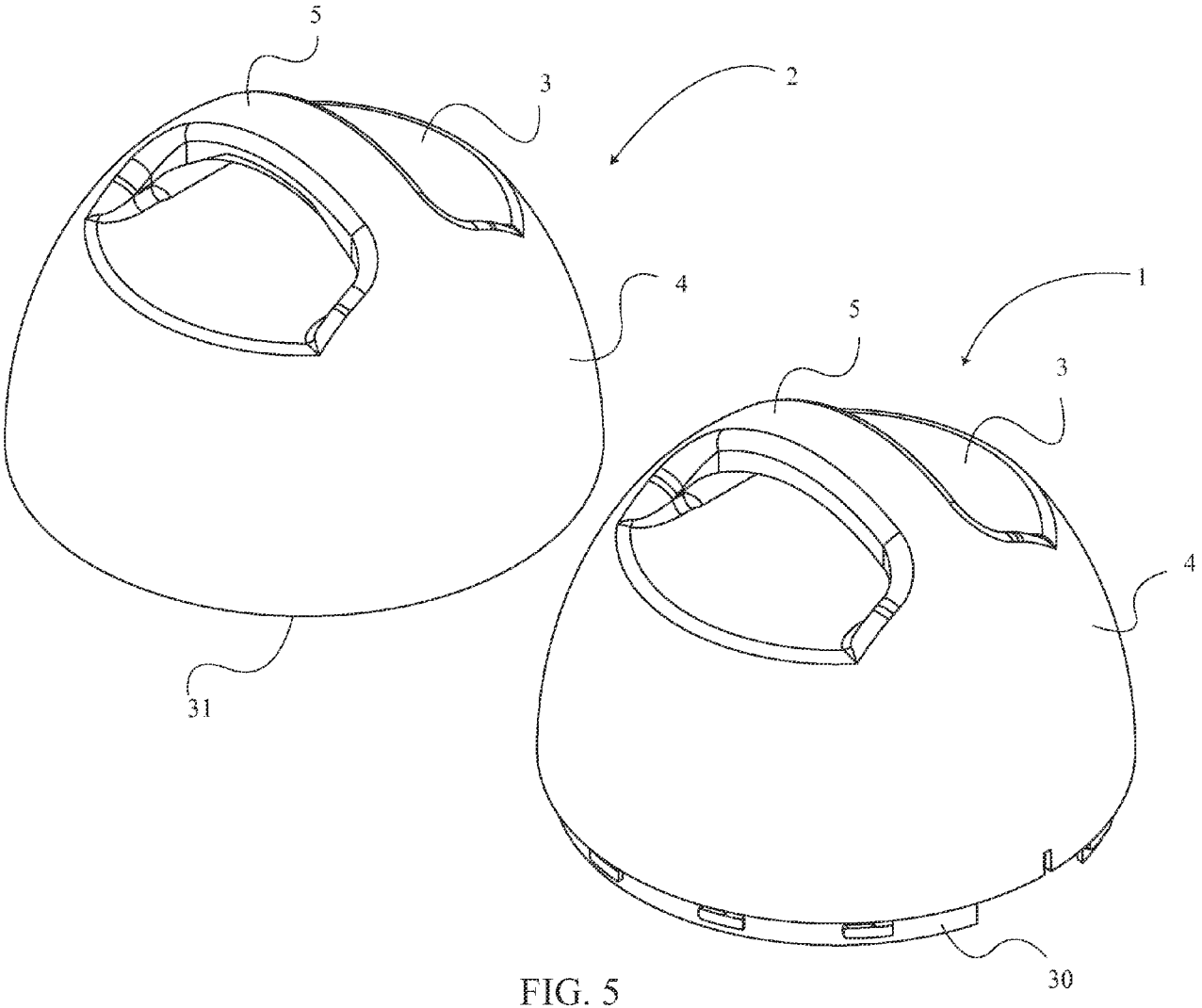
FIG. 5 is perspective view of the present invention, where the present invention is assembled to function as push-up handles or dumbbells.

As can be seen in FIG. 4, the present invention is a separable weight adjustable medicine ball, which can be used to perform a variety of physical exercises and work a number of different muscles. The present invention either can be used as a medicine ball, which is shown in FIGS. 1 and 2, or can be separated to use as dumbbells or push-up handles, which are shown in FIG. 5. The separable weight adjustable medicine ball comprises a top shell 1, a bottom shell 2, a plurality of weights 6, a top weight support 9, a bottom weight support 10, a top collar clamp 15, a bottom collar clamp 16, a shell connection 29, and a pair of shell locks 32. The top shell 1 and the bottom shell 2 form the outer casing of the present invention and house the other components of the present invention. The shell connection 29 allows the top shell 1 and the bottom shell 2 to be combined together when the present invention is being used as a medicine ball and allows top shell 1 the bottom shell 2 to be separated when the present invention is being used as dumbbells or push-up handles. The pair of shell locks 32 is diametrically opposed to each other along the shell connection 29 and secures the shell connection 29 when the top shell 1 and the bottom shell 2 are combined together. The plurality of weights 6 is separated and placed within the top shell 1 and the bottom shell 2. The top weight support 9 is connected to the top shell 1 and situates the plurality of weights 6 within the top shell 1. The top collar clamp 15 locks onto the top weight support 9 and presses the plurality of weights 6 against the top shell 1. Similarly, the bottom weight support 10 is connected to the bottom shell 2 and situates the plurality of weights 6 within the bottom shell 2. The bottom collar clamp 16 locks onto the bottom weight support 10 and presses the plurality of weights 6 against the bottom shell 2.

Figure 3:
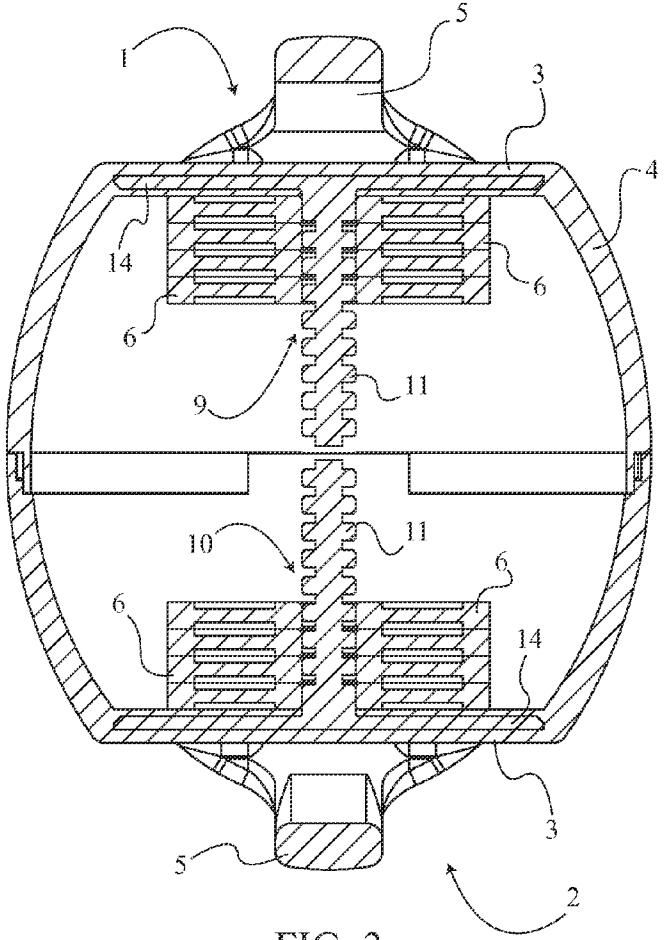
FIG. 3 is a cross sectional view of the present invention, which is referring to FIG. 2.

The outer casing of the present invention consists of the top shell 1 and the bottom shell 2, which have a rounded shape so that the present invention can be utilized as a medicine ball. The top shell 1 and the bottom shell 2 are illustrated in FIGS. 2 and 3. In the preferred embodiment of the present invention, the outer casing forms an egg shape when the top shell 1 and the bottom shell 2 are combined. The top shell 1 and the bottom shell 2 each comprise a base shell portion 3, a lateral shell portion 4, and a handle 5. The base shell portion 3 is the thickest part of either the top shell 1 or the bottom shell 2 because the base shell portion 3 of the top shell 1 is connected to the top weight support 9 and the base shell portion 3 of the bottom shell 2 is connected to the bottom weight support 10. Thus, the base shell portion 3 of the top shell 1 and the base shell portion 3 of the bottom shell 2 must bear the entire load placed on the top weight support 9 and the bottom weight support 10 by the plurality of weights 6. The lateral shell portion 4 has tubular shape and is positioned to encircle the center axis of the present invention. The base shell portion 3 is parametrically connected to the lateral shell portion 4, and, together, the base shell portion 3 and the lateral shell portion 4 form a half-an-egg shape. The handle 5 is used to comfortably grasp the top shell 1 or the bottom shell 2 while exercising with the present invention. The handle 5 has rounded shape and is connected to the base shell portion 3 opposite to the lateral shell portion 4.

Figure 6:
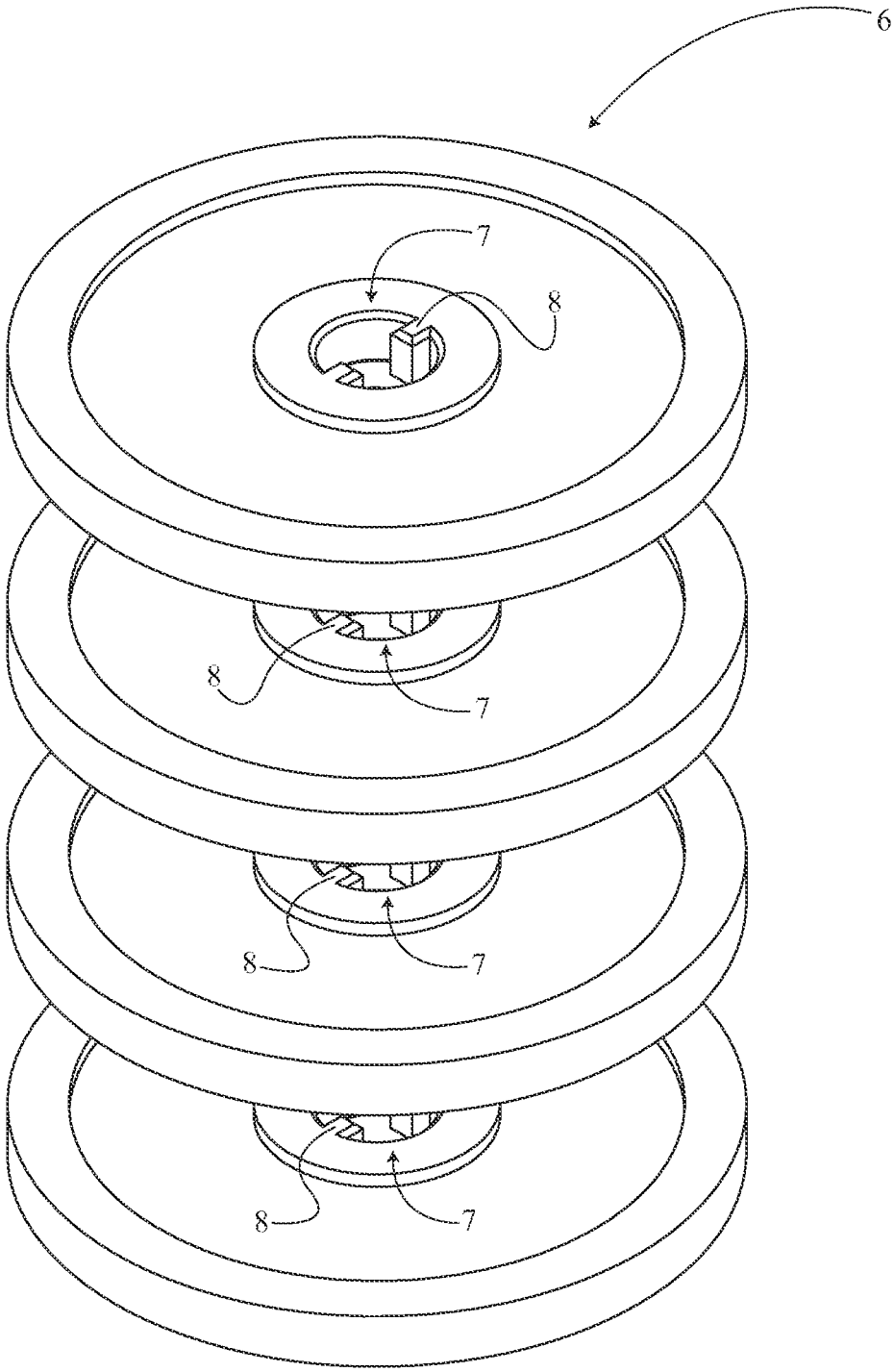
FIG. 6 is a detailed perspective view of only the plurality of weights.

The plurality of weights 6 shown in FIG. 6 allows a user to incrementally increase the load while exercising with the present invention. Each of the plurality of weights 6 consists of a center hole 7 and a pair of weight protrusions 8. The center hole 7 in each of the plurality of weights 6 is used to engage either the top weight support 9 or the bottom weight support 10. The center hole 7 is centrally positioned on each of the plurality of weights 6, which allows the plurality of weights 6 to evenly distribute its load onto either the top weight support 9 or the bottom weight support 10. The pair of weight protrusions 8 is diametrically opposed to each other along the center hole 7 and symmetrically jut into the center hole 7. The pair of weight protrusions 8 allows each of the plurality of weights 6 to be properly engaged by either the top weight support 9 or the bottom weight support 10.

Figure 7:
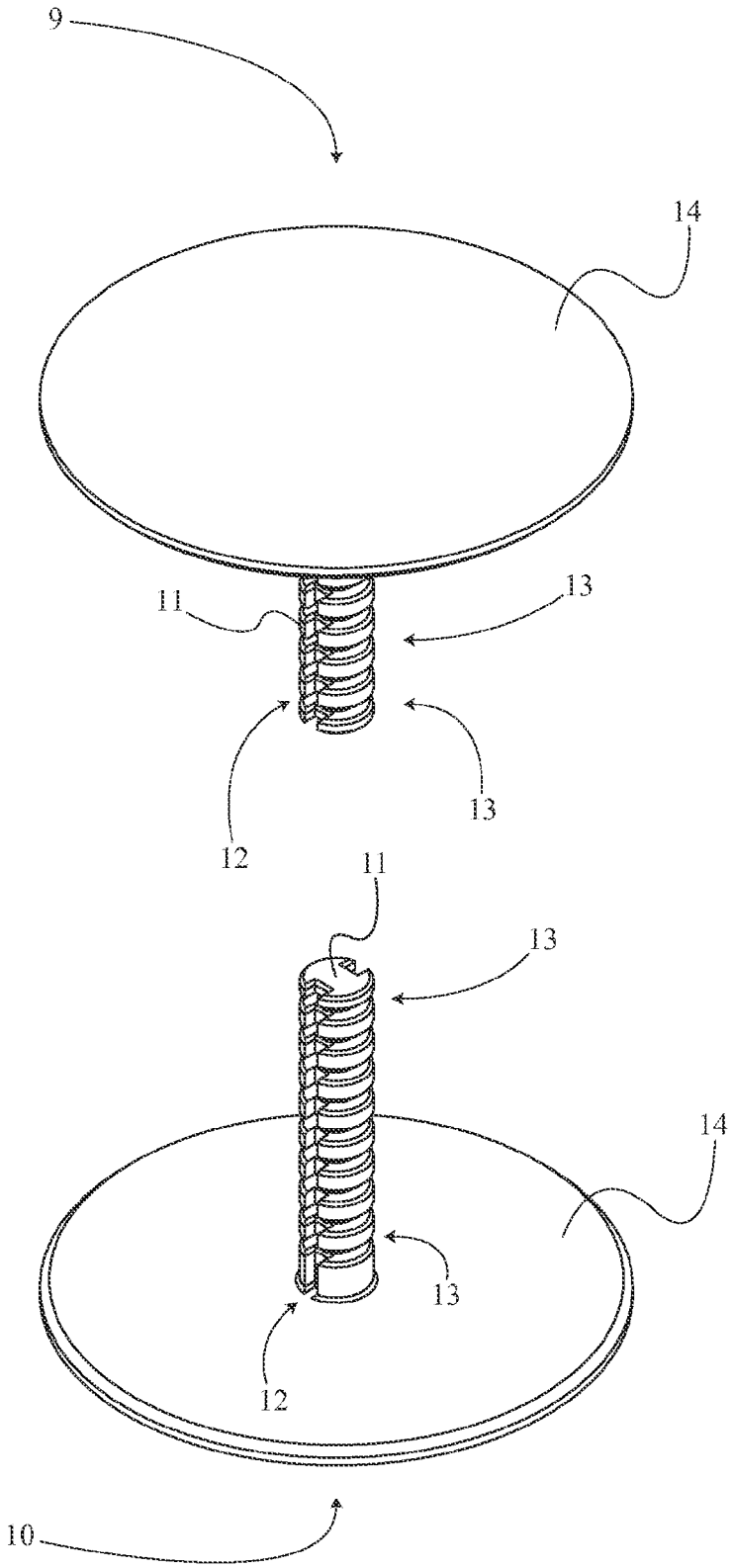
FIG. 7 is a detailed perspective view of only the top weight support and the bottom weight support.

The top weight support 9 and the bottom weight support 10 properly position the plurality of weights 6 within the top shell 1 and the bottom shell 2. As can be seen in FIG. 7, the top weight support 9 and the bottom weight support 10 each comprise a center rod 11 and a base plate 14. Both the center rod 11 of the top weight support 9 and the center rod 11 of the bottom weight support 10 traverse through the center hole 7 of each of the plurality of weights 6. Both center rods are located along the center axis of the present invention and concentrically position the plurality of weights 6 within the lateral shell portion 4 of both the top shell 1 and the bottom shell 2, which creates an even weight distribution throughout the present invention. The center rod 11 also consists of a pair of linear indentations 12 and a plurality of concentric indentations 13. The pair of linear indentations 12 is diametrically opposed to each other along the circumference of the center rod 11 and run along the length of the center rod 11. The pair of linear indentations 12 allows the pair of weight protrusions 8 of each of the plurality of weights 6 to engage the center rod 11 as the center rod 11 traverses through the center hole 7 of each of the plurality of weights 6. The pair of linear indentations 12 and the pair of weight protrusions 8 stabilize the plurality of weights 6 so that the plurality of weights 6 do not rotate on the center rod 11. The plurality of concentric indentations 13 is annularly shaped cavities, which are evenly spaced out along the length of the center rod 11. The plurality of concentric indentations 13 allows either the top collar clamp 15 or the bottom collar clamp 16 to engage the center rod 11 at the proper position along the center rod 11. The base plate 14 is located within the base shell portion 3, which allows either the top weight support 9 or the bottom weight support 10 to be adequately situated while supporting the plurality of weights 6 along the center axis of the present invention. The center rod 11 is concentrically connected to the base plate 14 and is normal to the base plate 14. The plurality of weights 6 are placed on the center rod 11 and pushed towards the base plate 14, but the plurality of weights 6 actual rests against the base shell portion 3 because the base plate 14 is located with the base shell portion 3, which can be seen in FIG. 3. In the preferred embodiment of the present invention, the top shell 1 and the bottom shell 2 are made of a hard plastic, and top weight support 9 and the bottom weight support 10 are made of a metal. Thus, for the manufacturing process of the preferred embodiment, the top shell 1 should be injected molded around the top weight support 9, and the bottom shell 2 should be injected molded around the bottom weight support 10.

Figure 8:
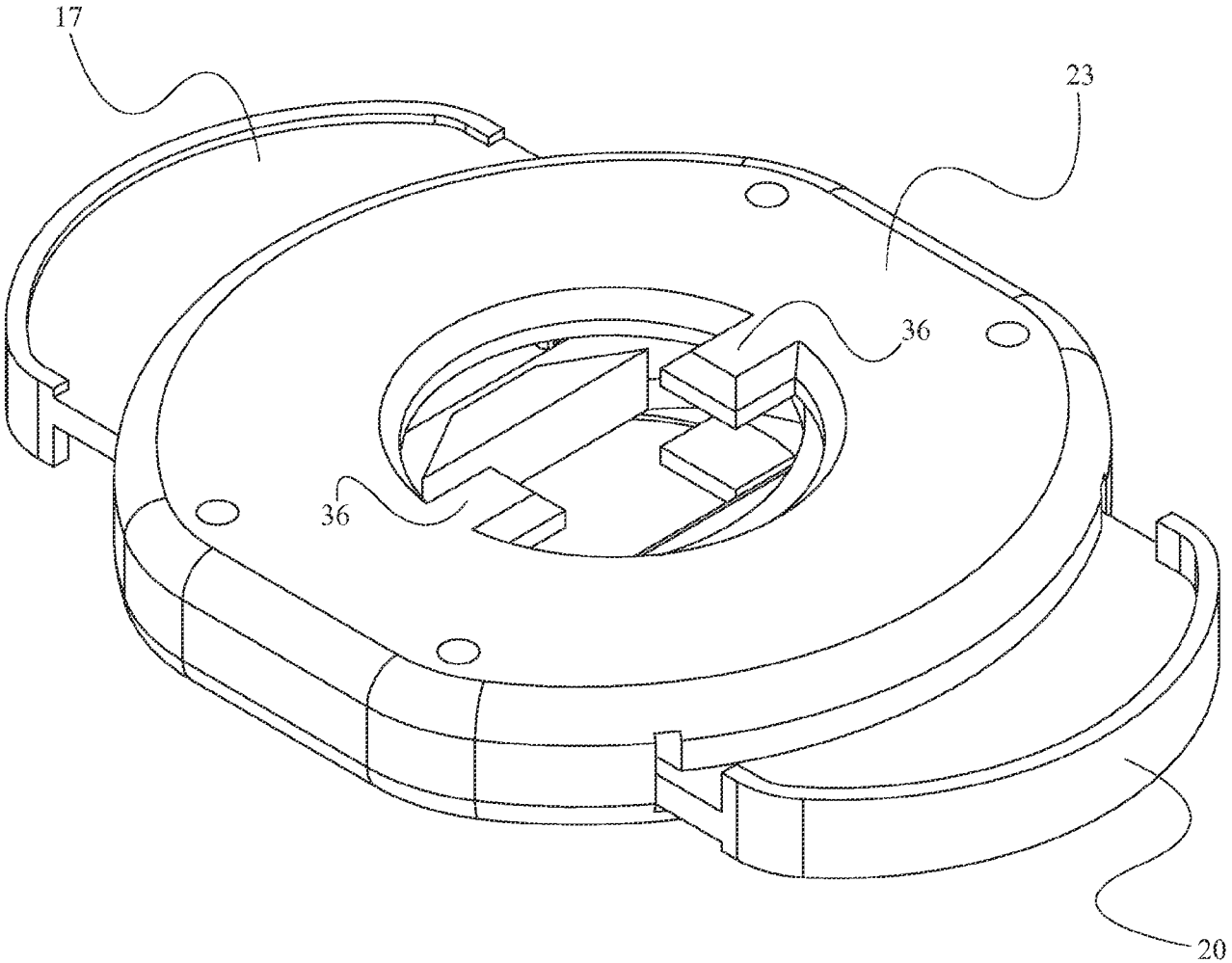
FIG. 8 is a detailed perspective view of either the top collar clamp or the bottom collar clamp.
Figure 9:
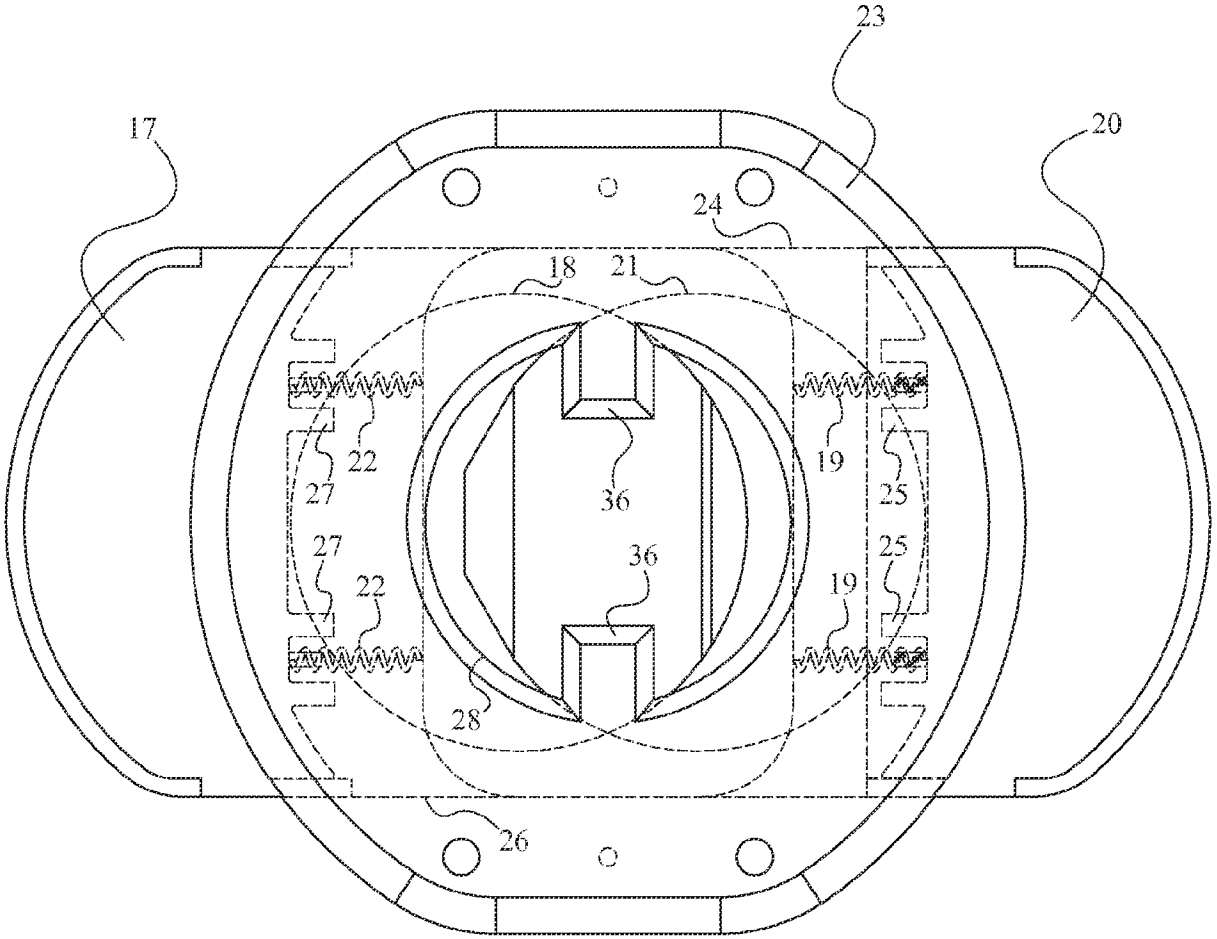
FIG. 9 is a top view of either the top collar clamp or the bottom collar clamp, where both the first clamp plate and the second clamp plate attached to the clamp housing.
Figure 10:
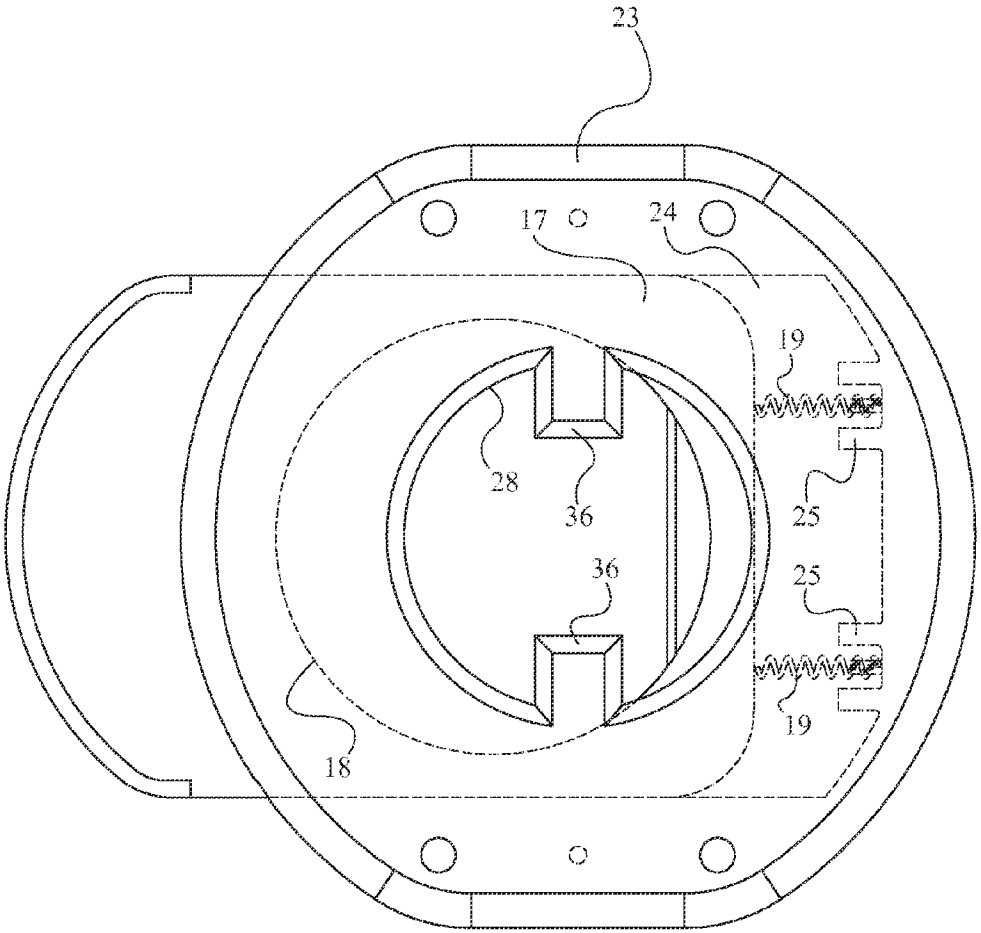
FIG. 10 is a top view of either the top collar clamp or the bottom collar clamp highlighting how the first clamp plate is inserted and connected to the clamp housing.
Figure 11:
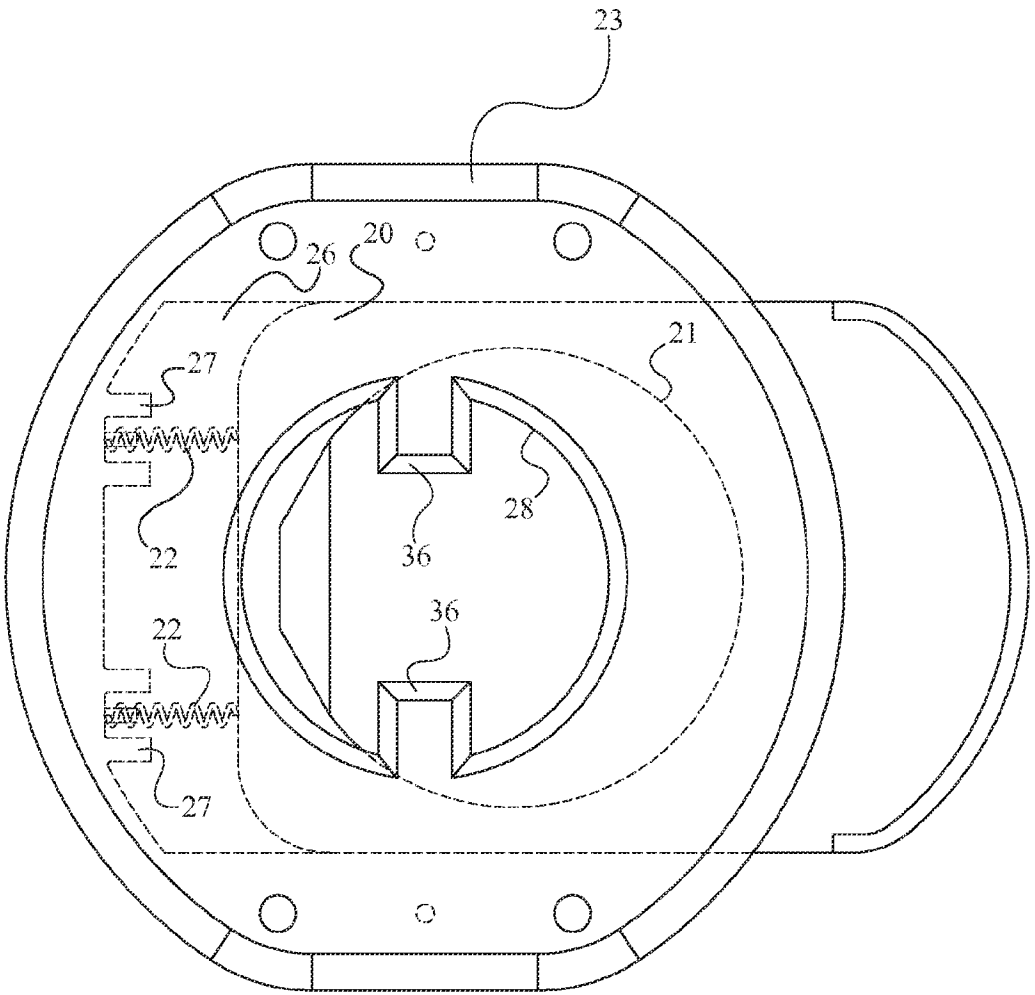
FIG. 11 is a top view of either the top collar clamp or the bottom collar clamp highlighting how the second clamp plate is inserted and connected to the clamp housing.

The top collar clamp 15 and the bottom collar clamp 16 allow the present invention to press the against the plurality of weights 6 and secure the plurality of weights 6 onto the top weight support 9 and the bottom weight support 10. FIG. 8 depicts either the top collar clamp 15 or the bottom collar clamp 16. The top collar clamp 15 and the bottom collar clamp 16 each comprise a first clamp plate 17, a plurality of first springs 19, a second clamp plate 20, a plurality of second springs 22, and a clamp housing 23. All components of either the top collar clamp 15 or the bottom collar clamp 16 are shown together in FIG. 9. The first clamp plate 17 and the second clamp plate 20 are pushed into the clamp housing 23 by the user to open the collar clamp. Once the user releases the first clamp plate 17 and the second clamp plate 20, the plurality of first springs 19 and the plurality of second springs 22, which are located inside the clamp housing 23, push the first clamp plate 17 and the second clamp plate 20 out of the clamp housing 23 to close the collar clamp. The clamp housing 23 provides the collar clamp with the structure to properly position the other components of the collar clamp so that they can perform their clamping function. The clamp housing 23 consists of a first plate cavity 24, a plurality of first spring supports 25, a second plate cavity 26, a plurality of second spring supports 27, a housing hole 28, and a pair of clamp protrusions 36. The first plate cavity 24 is positioned on one end of the clamp housing 23, and the second plate cavity 26 is positioned on the other end of the clamp housing 23. The first plate cavity 24 is also positioned atop the second plate cavity 26 so that the bottom of the first plate cavity 24 and the top of the second plate cavity 26 intersect each other. As can be seen in FIG. 10, the first clamp plate 17 is inserted into the first plate cavity 24 and slides along the first plate cavity 24. The plurality of first springs 19 is positioned in between the first clamp plate 17 and the end of the first plate cavity 24, which allows the plurality of first springs 19 to press against the end of the first plate cavity 24 and apply an outward force on the first clamp plate 17. The plurality of first springs 19 is connected to the first clamp plate 17 on one end and is connected to the end of the first plate cavity 24 on the other end, which allows the plurality of first springs 19 to apply an inward force on the first clamp plate 17. Each of the plurality of first springs 19 is held in place by the plurality of first spring supports 25, which are located on the end of the first plate cavity 24 adjacent to each of the plurality of first springs 19. As can be seen in FIG. 11, the second clamp plate 20 is similarly inserted into the second plate cavity 26 and slides along the second plate cavity 26. The plurality of second springs 22 is positioned in between the second clamp plate 20 and the end of the second plate cavity 26, which allows the plurality of second springs 22 to press against the end of the second plate cavity 26 and apply an outward force on the second clamp plate 20. The plurality of second springs 22 is connected to the second clamp plate 20 on one end and is connected to the end of the second plate cavity 26 on the other end, which allows the plurality of second springs 22 to apply an inward force on the second clamp plate 20. Each of the plurality of second springs 22 is held in place by the plurality of second spring supports 27, which are located on the end of the second plate cavity 26 adjacent to each of the plurality of second springs 22.

In order for the top collar clamp 15 and the bottom collar clamp 16 to perform their clamping function, the first clamp plate 17 must consist of a first plate hole 18, and the second clamp plate 20 must consist of a second plate hole 21. The housing hole 28 is centrally positioned on the clamp housing 23, which allows the center rod 11 to traverse through the center of either the collar clamp. When the top collar clamp 15 or the bottom collar clamp 16 are in the opened position, the user squeezes the first clamp plate 17 and the second clamp plate 20 into the clamp housing 23. The first plate hole 18 and the second plate hole 21 are respectively positioned on the first clamp plate 17 and the second clamp plate 20 in such a way that the first plate hole 18 and the second plate hole 21 are concentric with the housing hole 28 when the collar clamp is held in the opened position. The positioning of the first plate hole 18 and the second plate hole 21 allows the center rod 11 to traverse through either the entire collar clamp. When the collar clamp is in the closed position, the user releases the first clamp plate 17 and the second clamp plate 20, which engage the closest of the plurality of concentric indentations 13 in order to lock the collar clamp in place. The pair of clamp protrusions 36 is diametrically opposed to each other along the housing hole 28 and juts into the housing hole 28. The pair of clamp protrusions 36 allows the collar clamp to engage the pair on the linear protrusions 12 as the center rod 11 traverses through the center hole 7 of each of the plurality of weights 6.

The shell connection 29 is the means by which the top shell 1 and the bottom shell 2 are attached together and is shown in FIGS. 1 and 2. The shell connection 29 comprises a male threaded rim 30 and a female threaded rim 31, which are shown in FIG. 4. The male threaded rim 30 is parametrically connected to the lateral shell portion 4 of the top shell 1 opposite to the base shell portion 3 of the top shell 1. The female threaded rim 31 is also parametrically connected to the lateral shell portion 4 of the bottom shell 2 opposite to the base shell portion 3 of the bottom shell 2. In the preferred embodiment of the present invention, the male threaded rim 30 consists of a series of L-shaped protrusions, which are radially facing away the center axis of the present invention, and the female threaded rim 31 consists of a series of L-shaped cavities, which are radially facing towards the center axis of the present invention. To connect the top shell 1 to the bottom shell 2, the male threaded rim 30 is placed atop the female threaded rim 31 and rotated, until the series of the L-shaped protrusions is engaged to the series of L-shaped cavities.

Figure 12:
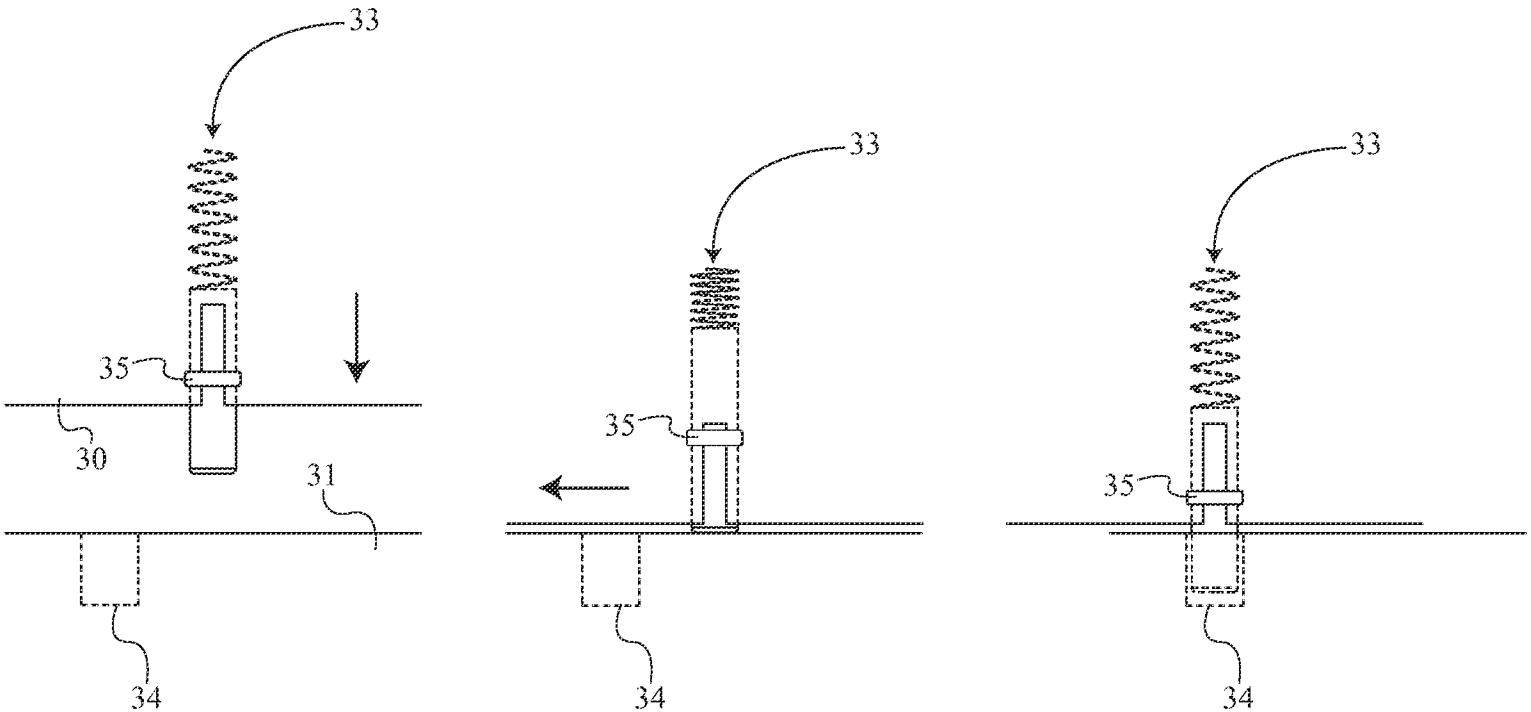
FIG. 12 is schematic diagram of how the shell lock should be put into the locked position.
Figure 13:
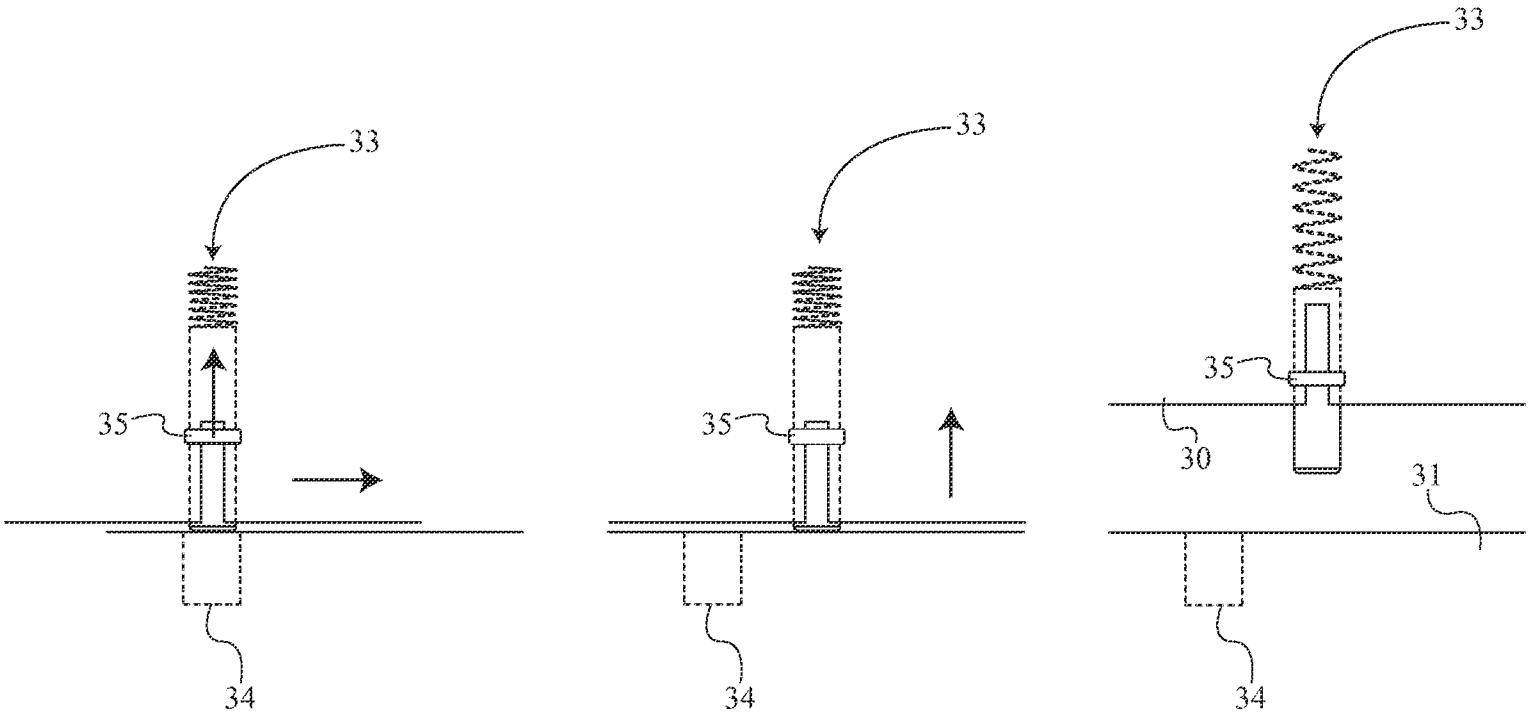
FIG. 13 is schematic diagram of how the shell lock should be unlocked from the locked position.

The pair of shell locks 32, which is shown in FIGS. 1 and 4, secures the shell connection 29 between the top shell 1 and the bottom shell 2. The pair of shell locks 32 is diametrically opposed to each other along the shell connection 29. Each of the pair of shell locks 32 comprises a spring loaded stub 33, a stub cavity 34, and a lock and unlock switch 35. The spring loaded stub 33 protrudes out of the male threaded rim 30. The lock and unlock switch 35 is perpendicularly attached to the spring loaded stub 33 and is positioned to be almost normal to the egg-shaped surface of the top shell 1. The stub cavity 34 is located on the female threaded rim 31 and is positioned to align with the spring loaded stub 33 once the pair of the shell locks are in the locked position. In the preferred embodiment of the present invention, the pair of shell locks 32 is in the locked position when the series of L-shaped protrusions and the series of L-shaped cavities are engaged to each other. When the male threaded rim 30 is placed on top of the female threaded rim 31, the spring loaded stub 33 is compressed into the male threaded rim 30, which can be seen in FIG. 12. When the male threaded rim 30 is rotated to engage the series of L-shaped protrusions to the series of L-shaped cavities, the spring loaded stub 33 becomes positioned over the stub cavity 34, which allows the spring loaded stub 33 to extend into the stub cavity 34. If the spring loaded stub 33 is protruding into the stub cavity 34, then the pair of shell locks 32 are in the locked position because the top male threaded rim 30 cannot be rotated in the opposite direction to disengage the series of L-shaped protrusions from the series of L-shaped cavities. As can be seen in FIG. 13, the lock and unlock switch 35 can be used to pull the spring loaded stub 33 out of the stub cavity 34, which allows the male threaded rim 30 to be rotated in the opposite direction to disengage the series of L-shaped protrusions from the series of the L-shaped cavities. In the preferred embodiment of the present invention, the lock and unlock switch 35 can include a thumb tab, which makes the lock and unlock switch 35 more user-friendly.

When the top shell 1 and the bottom shell 2 are locked together to form a medicine ball, the present invention can be used to perform medicine ball exercises that include but are not limited to: diagonal chops, core exercises, crunches, oblique twists, toss, etc. When the top shell 1 and the bottom shell 2 are separated, the present invention allows the user to perform other exercises including but not limited to: up-right rows, one arm row, bent over rows, seated rows, dips, front deltoid raises, lateral raises, shoulder press, bicep curls, tricep extensions, push-ups, pike push-ups, or plange push-ups. Additionally, the top shell 1 and the bottom shell 2 can be used as weights like dumbbells and kettle bells. The handle 5 of the top shell 1 and the handle 5 of the bottom shell 2 could be integrated with a soft or comfortable grip to allow exercise with less strain on the hands and wrists. As a result, the present invention will allow the user to perform pushups and other such exercises with reduced stress on the wrists and hands while still effectively working the muscles. Furthermore, numerous weights can be attached or detached to allow for different desired weights for different exercises. Ultimately, the present invention will allow the consumer to save money and space by buying only one device which will allow him or her to perform push up, dumbbell, kettle bell, and medicine ball exercises with varying weights.

Although the invention has been explained in relation to its preferred embodiment, it is to be understood that many other possible modifications and variations can be made without departing from the spirit and scope of the invention as hereinafter claimed.

What is claimed is:

1. A separable weight adjustable medicine ball comprises,
a top shell;
a bottom shell;
a plurality of weights;
a top weight support;
a bottom weight support;
a top collar clamp;
a bottom collar clamp;
a shell connection;
a pair of shell locks;
said top shell and said bottom shell each comprise a base shell portion, a lateral shell portion, and a handle;
each of said plurality of weights comprises a center hole and a pair of weight protrusions;
said top weight support and said bottom weight support each comprise a center rod and a base plate;
said top weight collar clamp and said bottom weight collar clamp each comprise a first clamp plate, a plurality of first springs, a second clamp plate, a plurality of second springs, and a clamp housing;
said shell connection comprises a male threaded rim and a female threaded rim;
said pair of shell locks comprises a spring loaded stub, a stub cavity, and a lock and unlock switch;
said center rod comprises a pair of linear indentations and a plurality of concentric indentations;
said first clamp plate comprises a first plate hole;
said second clamp plate comprises a second plate hole; and
said clamp housing comprises a first plate cavity, a plurality of first spring supports, a second plate cavity, a plurality of second spring supports, a housing hole and a pair of clamp protrusions.

2. The separable weight adjustable medicine ball as claimed in claim 1 comprises, said top weight support being centrally connected within said top shell;

said bottom weight support being centrally connected within said bottom shell;

said plurality of weights being traversed through by said top weight support and said bottom weight support;

said top collar clamp being attached to said top weight support adjacent to said plurality of weights;

said bottom collar clamp being attached to said bottom weight support adjacent to said plurality of weights;

said top shell being attached to said bottom shell by said shell connection;

said pair of shell locks being diametrically opposed to each other along said shell connection; and said top shell being secured to said bottom shell by said pair of shell locks.

3. The separable weight adjustable medicine ball as claimed in claim 1 comprises, said first plate cavity and said second plate cavity being positioned opposite to each other on said clamp housing;

said first plate cavity overlaying said second plate cavity within said clamp housing;

said first clamp plate being connected to said plurality of first springs;

said first plate cavity being connected to said plurality of first springs opposite to said first clamp plate;

said first plate cavity being traversed by said first clamp plate;

said second clamp plate being connected to said plurality of second springs;

said second plate cavity being connected to said plurality of second springs opposite to said second clamp plate;

said second plate cavity being traversed by said second clamp plate;

said plurality of first spring supports being positioned adjacent to said plurality of first springs on said first plate cavity;

said plurality of second spring supports being positioned adjacent to said plurality of said second springs on said second plate cavity;

said first plate hole being positioned on said first clamp plate adjacent to said plurality of first springs;

said second plate hole being positioned on said second clamp plate adjacent to said plurality of second springs;

said housing hole being centrally positioned on said clamp housing;

said housing hole being protruded into by said pair of clamp protrusions; and said pair of clamp protrusions being diametrically opposed to each other along said housing hole.

4. The separable weight adjustable medicine ball as claimed in claim 1 comprises, said base shell portion being parametrically connected to said lateral shell portion; and said handle being connected to said base shell portion opposite to said lateral shell portion.

5. The separable weight adjustable medicine ball as claimed in claim 1 comprises, said center rod being positioned normal to said base plate;

said center rod being concentrically connected to said base plate;

said pair of linear indentations being positioned along said center rod parallel to said center rod;

said pair of linear indentations being diametrically opposed to each other on said center rod;

said plurality of concentric indentations being evenly spaced along said center rod;

each of said plurality of concentric indentations being intersected by said pair of linear indentations;

said base plate being located within said base shell portion; and said center rod being encircled by said laterally shell portion.

6. The separable weight adjustable medicine ball as claimed in claim 1 comprises, said center hole being centrally positioned on each of said plurality of weights;

said center hole being protruded into by said pair of weight protrusions; and said pair of weight protrusions being diametrically opposed to each other along said center hole.

7. The separable weight adjustable medicine ball as claimed in claim 1 comprises, said center hole of each of said plurality of weights being traversed through by said center rod of said top weight support and said center rod of said bottom weight support;

said pair of linear indentations being engaged by said pair of weight protrusions of each of said plurality of weights;

said plurality of weights being positioned adjacent to said base shell portion;

said first plate hole, said second plate hole, and said housing hole of said top collar clamp being traversed through by said center rod of said top weight support;

said pair of linear indentations being engaged by said pair of clamp protrusions of said top collar clamp;

said first plate hole, said second plate hole, and said housing hole of said bottom collar clamp being traversed through by said center rod of said bottom weight support;

said pair of linear indentations being engaged by said pair of clamp protrusions of said bottom collar clamp; and said plurality of weights being secured in between said base shell portion of said top shell and said top collar clamp and in between said base shell portion of said bottom shell and said bottom collar clamp.

8. The separable weight adjustable medicine ball as claimed in claim 1 comprises, said male threaded rim being parametrically connected to said lateral shell portion of said top shell opposite to said base shell portion of said top shell;

said female threaded rim being parametrically connected to said lateral shell portion of said bottom shell opposite said base shell portion of said bottom shell; and said female threaded rim being engaged by said male threaded rim.

9. The separable weight adjustable medicine ball as claimed in claim 1 comprises, said spring loaded stub protruding out of said male threaded rim;

said spring loaded stub being positioned normal to said base shell portion of said top shell;

said lock and unlock switch being perpendicularly connected to said spring loaded stub; and said stub cavity being positioned on said female threaded rim adjacent to said spring loaded stub.

* * * * *